US007124843B2

(12) United States Patent
Hulkkonen et al.

(10) Patent No.: US 7,124,843 B2
(45) Date of Patent: Oct. 24, 2006

(54) BIT ASSEMBLY FOR A HAMMERING DRILL

(76) Inventors: Teijo Hulkkonen, Koivupirtinkatu 14, FI-33580 Tampere (FI); Hannu Paasonen, Kyyninkatu 8 A 15, FI-37100 Nokia (FI)

( * ) Notice: Subject to any disclaimer, the term of this patent is extended or adjusted under 35 U.S.C. 154(b) by 0 days.

(21) Appl. No.: 10/535,201

(22) PCT Filed: Nov. 18, 2003

(86) PCT No.: PCT/FI03/00876

§ 371 (c)(1),
(2), (4) Date: May 17, 2005

(87) PCT Pub. No.: WO2004/046496

PCT Pub. Date: Jun. 3, 2004

(65) Prior Publication Data

US 2006/0054362 A1 Mar. 16, 2006

(30) Foreign Application Priority Data

Nov. 18, 2002 (FI) ..... 20022043

(51) Int. Cl.
*E21B 10/36* (2006.01)

(52) U.S. Cl. ..... 175/384; 175/415

(58) Field of Classification Search ..... 175/381, 175/384, 389, 415

See application file for complete search history.

(56) References Cited

U.S. PATENT DOCUMENTS 2,400,853 A * 5/1946 Stilley ..... 175/106
2,815,932 A * 12/1957 Wolfram ..... 175/288
4,386,669 A * 6/1983 Evans ..... 175/269
4,478,296 A * 10/1984 Richman, Jr. ..... 175/92
4,940,097 A * 7/1990 Martini ..... 175/296
5,004,056 A * 4/1991 Goikhman et al. ..... 175/293
5,388,649 A * 2/1995 Ilomaki ..... 175/27
5,590,726 A 1/1997 Jarvela et al.

FOREIGN PATENT DOCUMENTS

| | | |
|---|---|---|
| DE | 28 29 868 | 4/1979 |
| EP | 0 195 265 | 9/1986 |
| EP | 0 429 649 | 6/1991 |
| FI | 85302 | 10/1989 |
| FR | 2.043.841 | 5/1970 |
| GB | 973790 | 10/1964 |

* cited by examiner

*Primary Examiner*—Hoang Dang
(74) *Attorney, Agent, or Firm*—Stites & Harbison PLLC; Douglas E. Jackson

(57) ABSTRACT

A bit assembly for a hammering and rotating drill, in which a main drill body (1) is arranged to drill essentially a middle portion of the hole and in the main drill body (1) there is mounted one or more outer bits (2),(3) arranged to drill an outer circle of the hole. The outer drilling bits (2),(3) are arranged to drill an outer drilling surface which is located behind a middle drilling surface of the main drill body in the drilling direction. The outer bits (2),(3) are further mounted in the drill body (1) in formed counter cavities (7), the axial directions (S) of which are either the same direction as the drilling direction or which deviate outwards from the drilling direction. The outer bits can be moved at least a part of the way out of the counter cavities, in order to be moved in a direction which deviates from the axial direction (S) of the counter cavity.

10 Claims, 2 Drawing Sheets

BIT ASSEMBLY FOR A HAMMERING DRILL

FIELD OF THE INVENTION

The invention relates to a bit assembly for a hammering and rotating drill. The assembly includes a main drill body arranged to drill essentially a middle portion of a hole. In the main drill body there is mounted one or more outer hammering bits arranged to drill an outer circle of the hole. The outer drilling bits are arranged to drill a drilling surface which is located behind the main drill body drilling surface. The outer bits are further mounted in the main drill body in formed counter cavities, the axial directions of which either have a same direction as the drilling direction or deviate outwards from it.

BACKGROUND OF THE INVENTION

There is known from patent publication FI-95618 a drilling apparatus in which an outer circle of the hole drilling ring bit acts to drill an outer circle, so that a casing tube can be pulled into the hole in connection with the drilling. However, when the drilling apparatus is pulled out from the hole so that the casing tube remains in the hole, the ring bit also has to remain in the hole bottom.

Also from patent publication FI-85302 there is known a drilling apparatus for drilling large holes in which the center locating bit drills a hole center portion, and separately on the outer circle of the drilling apparatus there are placed bits which drill the outer circle of the hole. The outer circle drilling bits have rotating and hammering devices of their own. The drilling apparatus is used for drilling of horizontal holes, so that the drilling apparatus is meant ultimately to penetrate through the ground into free space.

It is well known where drilling is carried out by a rotating bit which is mounted eccentric in relation to a center axis of the casing tube, that it is possible to drill a larger hole than the diameter of the casing tube. When drilling is stopped, the eccentricity of the bit in relation to the center axis of the casing tube is changed, so that the bit can be pulled out from the hole and the casing tube is left in the hole.

The disadvantage for the drilling apparatuses in which the ring bit must be left in the hole is that there is then lost in every hole a relatively expensive bit. The disadvantage when an eccentric bit is used which must be lifted up from the hole is that the bit will wear very quickly because the drilling surface in the bit is substantially smaller than the drilling surface of the hole, so that the worn bits have to be changed often. In certain drilling apparatuses where the drilling bits can be pulled against each other thus allowing the bit assembly to be lifted up in spite of the casing tube, the disadvantage is that the mechanism by which the bits are pulled against each other has to be complicated, and it is difficult to change the bits and they can be very easily damaged.

SUMMARY OF THE INVENTION

By means of the bit assembly according to the invention, the above noted existing problems can be unexpectedly solved. With the bit assembly according to the invention, there are counter cavities mounted outer bits which can be moved at least a part of their way out of the counter cavities in the direction which deviates from the axial direction of the counter cavity in order to make the outer diameter of the hammering drill smaller.

The advantage for the bit assembly according to the invention is that a large hole drilling, e.g., diameter 300–1000 mm, is possible by means of hammering devices. This is possible thanks to many separate outer hole drilling bits mounted on the outer circle of the main hole drill body, so that the total drilling surface area of the main hole drill body is smaller than the total front surface area of the drilled hole. Thus, the bit assembly does not need to be so effective and inconvenienced by a heavy hammer device, as compared with corresponding drills whose bit is hammering against the whole drilling surface needed to provide the whole hole.

The separate outer circle drilling bits can also easily be changed. Further the outer circle drilling bits can be mounted in the drill body in such a way that when the bit assembly is pulled out from the hole, the bits move inwards at the casing tube edge. This allows the pulling of the whole bit assembly out while the casing tube remains in the hole. In the solution of the present invention, no expensive drill bit remains in the hole and drilling becomes more advantageous.

BRIEF DESCRIPTION OF THE DRAWINGS

In the following the invention is more closely described by referring to the enclosed drawings, where

FIG. 5*a* shows a section view of an alternative bit mounting in a drill body.

DETAILED DESCRIPTION OF THE INVENTION

Figure 1:
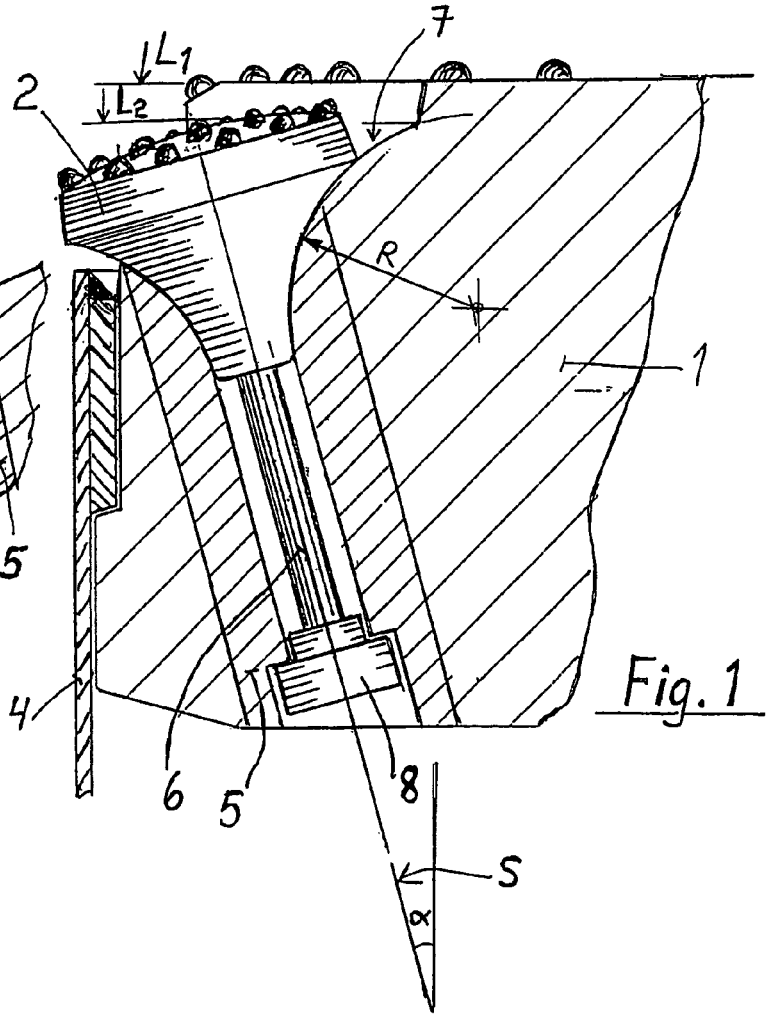
FIG. 1 shows a section view of the outer circle hole drilling bit mounted in a drill body.
Figure 4:
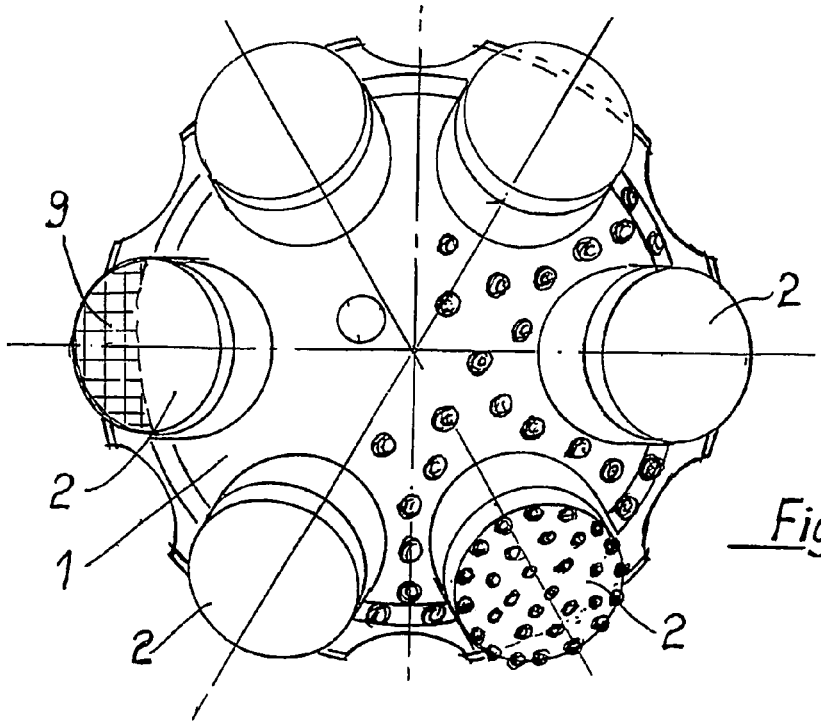
FIG. 4 shows the bit assembly of FIG. 1 seen from the front.

FIG. 1 shows a main drill body 1 for a hammering drill which drills, by means of its drilling surface at level L1, essentially a center portion of a hole. Many smaller bits 2 have been mounted in the main drill body 1 for drilling an outer circle of the hole. The fitting surface for each bit 2 is a curved counter surface or cavity 7 whose curvature can be radius R. The bits 2 drill a hole whose diameter is little larger than that required for a casing tube 4 to follow thereafter into the drilled hole. Each bit 2 is rotated in relation to an axis S of the associated counter surface 7 as shown, so that the bit 2 rotates in counter cavity 7. The rotation is desired and obtained by having the drilling surface level L2 of the bit 2 located behind, in the drilling direction, the drilling surface level L1 of the main drill body 1. It will be noted that the bit 2 does not drill by any other portion other than the bit portion which is located in the outer edge of the circle beyond the main drill body 1. There is depicted in FIG. 4 an area 9 which is the bit portion with which the bit 2 mainly drills. It will be appreciated that the rotation of the whole hammering drill causes a moment to be directed to each bit 2, which moment causes the bit 2 to rotate around the axis S.

Figure 2:
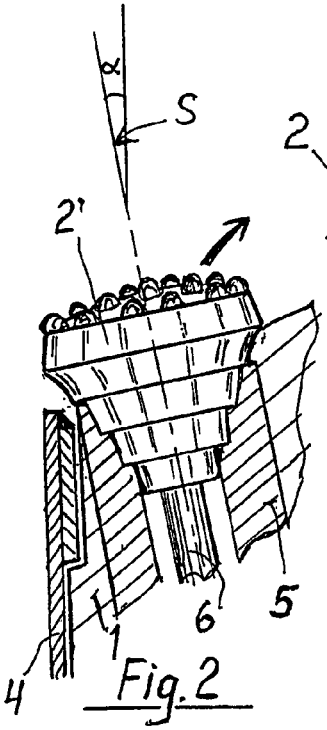
FIG. 2 shows a section view of an alternative bit mounting.

The bit 2 can be mounted in the main drill body 1 by using a separate bushing 5 which is placed into a hole drilled in the drill body 1. It is easier to machine in the bushing 5 and the needed counter cavities 7, for example in the main drill body 1. In FIG. 2 there is presented an alternative counter cavity assembly which is formed to be step-like. Consistent therewith, the bit 2' has a step-like design as well. The mounting of the bit 2 or 2' into the counter cavity in the axial direction S as shown in the figures forms with the drilling direction preferably an angle $\alpha$. The axial direction S of the counter cavity deviates advantageously outwards from the drilling direction. The angle α is thus advantageously between 0–30°. The axial direction S of the counter cavity can possibly be the same as the drilling direction, as it is in the FIG. 5*a*. However, it facilitates a little the construction of the hammering drill if the angle α is larger than 0 as shown in FIGS. 1–2.

Figure 3:
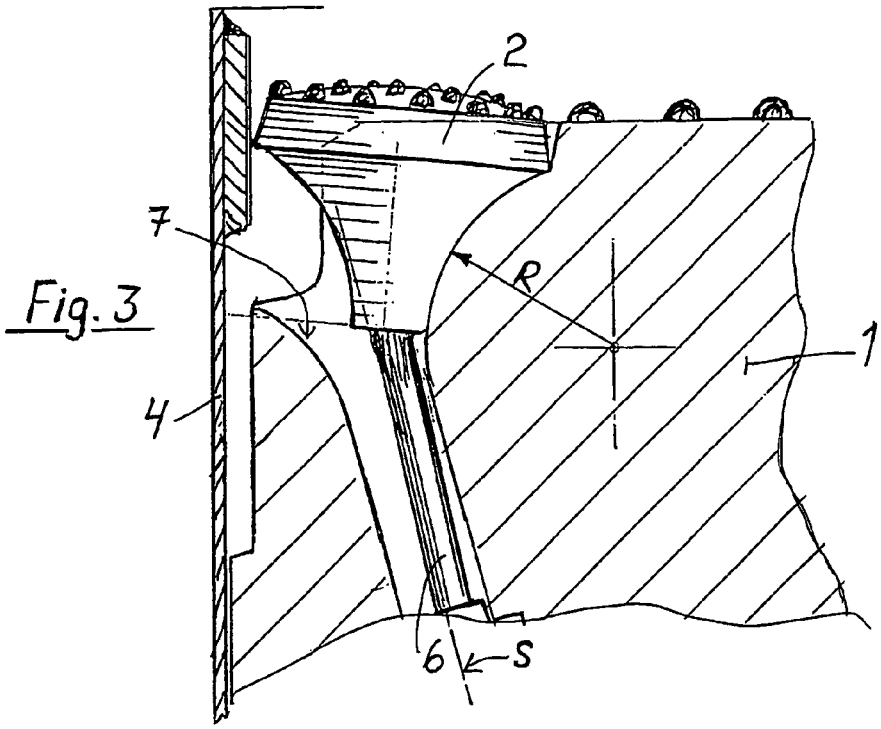
FIG. 3 shows a bit mounted according to FIG. 1 moving inwards at the casing tube.

FIG. 3 depicts how the bit 2 of the bit assembly according to the invention is moved to the side by the casing tube 4 when the whole hammering drill is pulled out from the hole through the casing tube 4. The material of the arm 6 fixing the bit 2 is selected so that it allows the bit 2 to move out and to the side a needed distance as shown. The shape of the counter surface 7 causes the bit to glide and turn inwards, so that the bit 2 does not at all move out in the axial direction S of the counter cavity. The casing tube 4 thus accomplishes the moving of the bit 2. When the whole hammering drill has been taken out from the casing tube, the bit 2 will then move back into its counter cavity. The fixing arm 6 is, for example, spring-like and therefore stretchy, and it is required that fixing arm 6 will bend at least at one point. It can be manufactured of pull resistant materials totally or combined, wherein it can comprise separately a stretchy portion and separately a bending portion. Rubbers, plastics, fiber materials, steel springs or similar can be used. The bending of the fixing arm can also be accomplished by means of an articulated joint. In the drilling situation, the fixing arm 6 urges the bit 2 against the counter cavity. The fixing arm 6 and a possible holder part 8 will preferable rotate with the bit 2 when it rotates.

Figure 5:
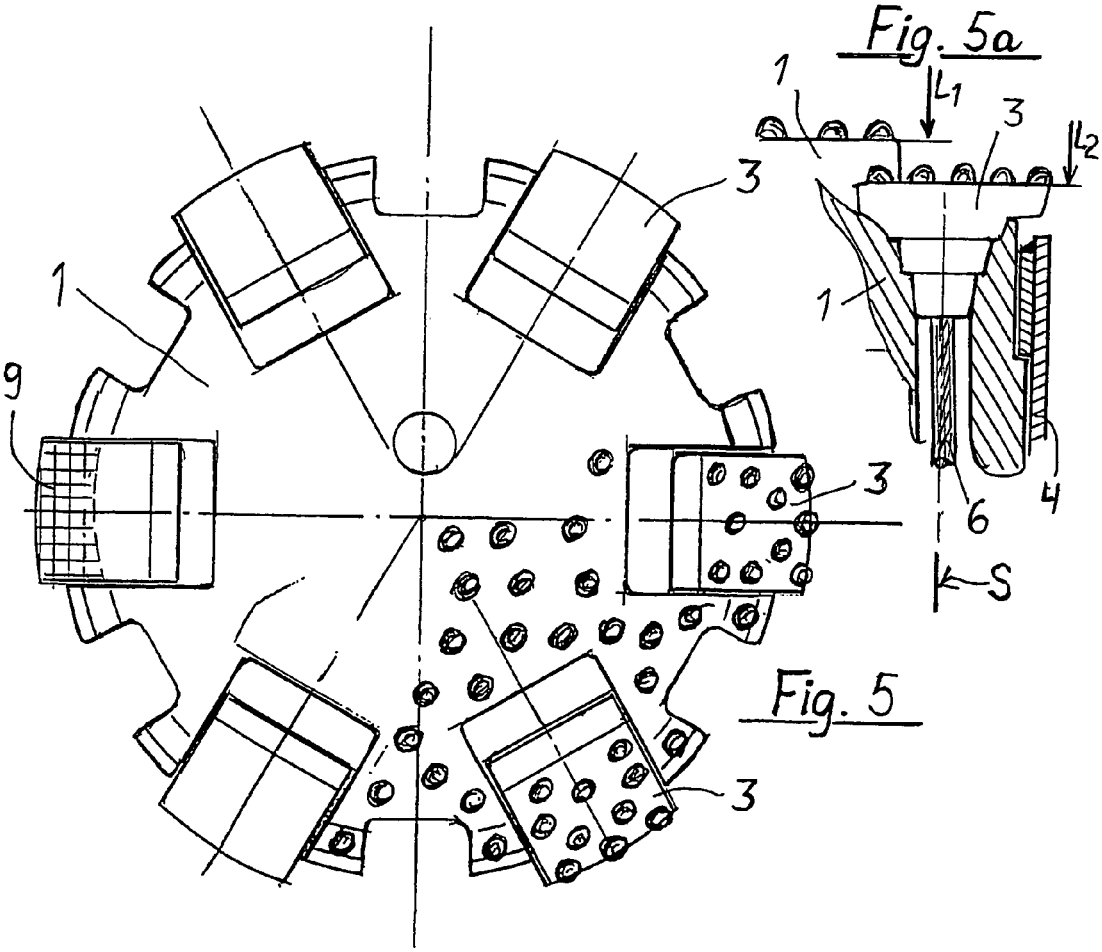
FIG. 5 shows an alternative bit assembly seen from the front.

In FIG. 5 there is depicted a bit 3 which has an angular form, and which does not rotate in its counter cavity. The moving of the bit 3 out of the cavity as pushed by the casing tube 4 can, however, happen in the same way as described for bit 2 or 2' in FIGS. 2 and 3 (i.e., based on the curved or step-like side form). The bits 3 always have the same area in the drilling phase, so that the bits 3 will wear a little sooner than the bits 2. The changing of the bits 2 and 3 takes, however, only a short time when the drill body 1 has been removed from the hole.

It will be appreciated that the bit assembly according to the invention becomes cheaper as larger holes are drilled. It will also be appreciated that the center drilling surface will have a longer duration and smaller strain than if only one full-sized center surface or bit drilled the whole hole. Also the power required for the hammer device can be smaller when the effective bit surface area does not correspond to the whole drilling surface. It will further be appreciated that the drilling of the hole takes a little more time when carried out according to the invention, as compared with drilling by one bit using a heavy hammer device.

In FIG. 5*a* there is depicted a section view of the unrotatable bit 3 where the bit 3 is located in its counter cavity. It will be appreciated that the axial direction S of the counter cavity is the same as the drilling direction. When the drilling unit is pulled out from the hole, the front edge of the casing tube 4 pushes the bit 3 so that the bit 3 turns to the center axis of the drill body 1 as depicted by the arrow. The arm 6 thus stretches and bends so that the bit 3 is able to pass by the casing tube.

What is claimed is:

1. A bit assembly for a hammering and rotating drill, comprising:

a main drill body which drills essentially a middle portion of a hole in a drilling direction at a main drilling surface; and at least one outer drilling bit mounted bit mounted in the main drill body which drills an outer circle of the hole located about the middle portion and having an outer diameter, the at least one outer drilling bits drilling at an outer drilling surface which is located relative to the drilling direction behind the main drilling surface;

wherein the main drill body includes a respective at least one counter cavity in which the respective at least one outer drilling bit is mounted, the at least one counter cavity having an axial directions which either has a same direction as the drilling direction or has a deviation outwards from the drilling direction; and wherein the at least one outer drilling bit can be moved at least a part of the way out of the at least one counter cavity in a direction which deviates from the axial direction of the at least one counter cavity in order to make the outer diameter smaller.

2. A bit assembly according to claim 1, further including a mounting means for mounting the at least one outer drilling bit for rotation in the at least one counter cavity.

3. A bit assembly according to claim 1, further including a mounting means for mounting the at least one outer drilling bit non-rotatably in the at least one counter cavity.

4. A bit assembly according to claim 1:

wherein the at least one outer drilling bit includes a drill surface having a surface portion which effects drilling of the outer circle; and further including a means for mounting the at least one outer drilling bit for rotation about a rotation axis and for being driven in rotation by a rotation of the main drill body.

5. A bit assembly according to claim 1:

further including a casing tube following after the main drill body and the at least one outer drilling bit during drilling, and wherein the at least one outer drilling bit is moved at least part of the way out from the at least one counter cavity so that the at least one outer drilling bit fits wholly inside the casing tube whereby the main drill body and at least one outer drilling bit can be removed through the casing tube.

6. A bit assembly according to claim 1:

wherein the at least one counter cavity includes a cavity side portion which is curved; and wherein the at least one outer drilling bit includes a bit side portion which is matingly curved and engaged with the cavity side portion such that the at least one outer drilling bit is moved by sliding engagement of the bit side portion with the cavity side portion when the at least one outer drilling bit moves at least part of the way out of the at least one counter cavity.

7. A bit assembly according to claim 1, wherein a side portion of the at least one counter cavity is step-like.

8. A bit assembly according to claim 1, wherein the at least one outer drilling bit includes a fixing arm by which the at least one outer drilling bit is mounted in the at least one counter cavity, the fixing arm allowing a remainder of the at least one outer drilling bit to move a needed distance in a wanted direction to effect a movement of the at least one outer drilling bit at least part of the way out from the at least one counter cavity.

9. A bit assembly according to claim 1, wherein the at least one counter cavity is a separate bushing which is fixed in a hole drilled into the main drill body.

10. A bit assembly according to claim 8, wherein the fixing arm can be disassembled to effect a changing of the at least one outer drilling bit.

* * * * *